US011172772B2

(12) United States Patent
Heiberger et al.

(10) Patent No.: US 11,172,772 B2
(45) Date of Patent: Nov. 16, 2021

(54) STRAW CAP WITH AN OPEN AND CLOSED VALVE MECHANISM

(71) Applicant: HYDRAPAK LLC, Oakland, CA (US)

(72) Inventors: Robert Heiberger, Boulder, CO (US); David Roecker, Denver, CO (US)

(73) Assignee: HYDRAPAK LLC, Oakland, CA (US)

( * ) Notice: Subject to any disclaimer, the term of this patent is extended or adjusted under 35 U.S.C. 154(b) by 41 days.

(21) Appl. No.: 16/558,593

(22) Filed: Sep. 3, 2019

(65) Prior Publication Data

US 2020/0085217 A1 Mar. 19, 2020

Related U.S. Application Data

(60) Provisional application No. 62/725,718, filed on Aug. 31, 2018.

(51) Int. Cl.

| | |
|---|---|
| ***A47G 19/22*** | (2006.01) |
| ***B65D 47/20*** | (2006.01) |
| ***B65D 43/02*** | (2006.01) |
| ***B65D 51/24*** | (2006.01) |

(52) U.S. Cl.

CPC ..... *A47G 19/2222* (2013.01); *B65D 43/0229* (2013.01); *B65D 47/20* (2013.01); *B65D 51/24* (2013.01)

(58) Field of Classification Search

CPC .. B65D 47/243; B65D 47/2093; B65D 47/26; B65D 47/061; B65D 41/023; B65D 2517/0049; A47G 19/2222; A47G 19/2272; A47G 21/18

See application file for complete search history.

(56) References Cited

U.S. PATENT DOCUMENTS

| | | | |
|---|---|---|---|
| 2,969,168 | A | 1/1961 | Newby |
| 3,201,013 | A | 8/1965 | Porter et al. |
| 3,240,399 | A | 3/1966 | Frandeen |
| 3,294,294 | A | 12/1966 | Amburgey |
| 3,511,420 | A | 5/1970 | Kessler |
| 4,428,508 | A | 1/1984 | Gardikas et al. |
| 4,457,454 | A | 7/1984 | Meshberg |

(Continued)

FOREIGN PATENT DOCUMENTS

| | | |
|---|---|---|
| DE | 20-2013-006816 | 8/2013 |
| KR | 101007083 | 1/2011 |

(Continued)

OTHER PUBLICATIONS

International Search Report and Written Opinion for International (PCT) Patent Application No. PCT/US2018/52664, dated Jan. 18, 2019 10 pages.

(Continued)

*Primary Examiner* — Jeffrey R Allen
(74) *Attorney, Agent, or Firm* — Sheridan Ross P.C.

(57) ABSTRACT

A beverage container is disclosed with a cap body having an upper straw with an incorporated valve that moves upward and downward to toggle between an open and closed position and a lower straw that is stationary within the cap body. Hermetic seals are formed between the straw bodies and cap body that allow the proper operation of a straw that opens, allowing fluid to flow through the straw bodies, and closes, stopping the flow of fluid through the straw bodies.

20 Claims, 11 Drawing Sheets

(56) References Cited

U.S. PATENT DOCUMENTS

| | | | | |
|---|---|---|---|---|
| 4,629,098 | A | 12/1986 | Eger | |
| 4,976,384 | A | 12/1990 | Soloman | |
| 5,022,562 | A | 6/1991 | Lurkis et al. | |
| 5,094,363 | A | 3/1992 | Monahan et al. | |
| 5,145,094 | A | 9/1992 | Perlmutter | |
| 5,494,198 | A | 2/1996 | Heiberger | |
| 5,607,073 | A | 3/1997 | Ferrer | |
| 5,651,471 | A | 7/1997 | Green | |
| 5,669,427 | A | 9/1997 | Hasper et al. | |
| 5,775,528 | A | 7/1998 | Wohlgemuth et al. | |
| 5,788,125 | A | 8/1998 | Steiner et al. | |
| 5,839,623 | A | 11/1998 | Losenno et al. | |
| 5,850,908 | A | 12/1998 | Jasek | |
| 5,927,565 | A * | 7/1999 | Paczonay | B65D 47/243 222/484 |
| 6,029,855 | A | 2/2000 | Adams | |
| 6,095,382 | A | 8/2000 | Gross | |
| 6,764,064 | B2 | 7/2004 | Sturm et al. | |
| 7,753,234 | B1 | 7/2010 | Heiberger | |
| 8,646,663 | B2 | 2/2014 | Heiberger | |
| 9,102,447 | B2 | 8/2015 | Pilis | |
| 10,322,855 | B2 | 6/2019 | Heiberger et al. | |
| 10,835,065 | B2 * | 11/2020 | Lohn | A47G 21/185 |
| 2013/0214012 | A1 | 8/2013 | Pils et al. | |
| 2014/0263377 | A1 * | 9/2014 | Olmedo | A47G 19/2222 220/708 |
| 2020/0002064 | A1 | 1/2020 | Heiberger et al. | |

FOREIGN PATENT DOCUMENTS

| | | |
|---|---|---|
| WO | WO 97/33804 | 9/1997 |
| WO | WO 97/44247 | 11/1997 |
| WO | WO 98/38103 | 9/1998 |

OTHER PUBLICATIONS

International Preliminary Report on Patentability for International (PCT) Application No. PCT/US2018/052664, dated Apr. 9, 2020, 9 pages.

Official Action for U.S. Appl. No. 15/715,019, dated Sep. 26, 2018 13 pages.

Notice of Allowance for U.S. Appl. No. 15/715,019, dated Feb. 8, 2019 13 pages.

Corrected Notice of Allowance for U.S. Appl. No. 15/715,019, dated May 14, 2019, 2 pages.

Official Action for U.S. Appl. No. 16/445,045, dated Jun. 11, 2020, 12 pages.

Official Action for U.S. Appl. No. 16/445,045, dated Nov. 20, 2020, 8 pages.

Extended European Search Report for European Patent Application No. 18857608.6, dated Jun. 18, 2021, 7 pages.

* cited by examiner

STRAW CAP WITH AN OPEN AND CLOSED VALVE MECHANISM

CROSS-REFERENCE TO RELATED APPLICATION

The present application claims the benefit, under 35 U.S.C. § 119(e), of U.S. Provisional Application Ser. No. 62/725,718 filed Aug. 31, 2018 entitled "Straw Cap with an Open and Closed Valve Mechanism," the entirety of which is incorporated herein by this reference.

FIELD OF THE INVENTION

The present disclosure relates to systems, methods and apparatus for forming a hermetic seal between the body of a straw and an associated cap or lid for a handheld beverage container. According to the present disclosure, a cap includes a straw for consumption of a beverage and the straw includes a valve to open and close access to the beverage within the container.

BACKGROUND

There are many instances when consumers drink from a capped beverage container that has a straw protruding from the top or lid of the container. A straw coupled with a top or lid prevents spills when one is active or mobile, such as drinking within an automobile or while bicycling or walking. A straw also prevents spills associated with ice splashing within an open cup as it is tilted toward the mouth in a drinking motion. Some women prefer a straw to a cup because it does not smear their lipstick. Similarly, people who have had their teeth whitened will opt to drink coffee through a straw to reduce contact between the coffee and their teeth. Also, athletes participating in contact sports can quickly drink through the mouth guard of a helmet using a straw. Given the popularity of straws, there is a need to improve the performance of a simple straw and top from which it protrudes.

U.S. Pat. Nos. 7,753,234 and 8,646,663, and US published patent application 2018/0086517 are incorporated herein by reference, in their entirety.

SUMMARY

A beverage container cap is disclosed having a straw that incorporates a valve that opens and closes. In the open mode, the valve enables the beverage within the container to flow through the straw while allowing ambient air to flow through vents in the cap to prevent the formation of a vacuum or negative pressure within the beverage container that will restrict the fluid flowing through the straw. In the closed mode, the valve forms a gas tight seal that prevents fluid from flowing through the straw and leaking from the cap. The container cap has an upper straw with an incorporated valve that slides upward and downward within the container top to toggle between the open and closed modes and a lower straw that is stationary within the container cap. When the upper straw valve moves to the open position an orifice opens to allow liquids to flow through the straw and a venting channel opens to allow ambient air to flow around the upper straw body to relieve negative pressures within the beverage container. This patent describes the method of forming hermetic seals between the straw bodies and cap body that allow the proper operation of a straw that opens and closes.

This Summary is neither intended nor should it be construed as being representative of the full extent and scope of the present invention. Moreover, reference made herein to aspects of the present disclosure should be understood to mean certain embodiments of the present invention and should not necessarily be construed as limiting all embodiments to a particular description. Embodiments are set forth in various levels of detail in the Summary as well as in the attached drawings and the Detailed Description and no limitation as to the scope of the present invention is intended by either the inclusion or non-inclusion of elements, components, etc. in this Summary.

DESCRIPTION OF THE DRAWINGS

The accompanying drawings, which are incorporated in and constitute a part of the specification, illustrate embodiments of the disclosure and together with the general description of the disclosure given above and the detailed description given below, explain the principles of the disclosure.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
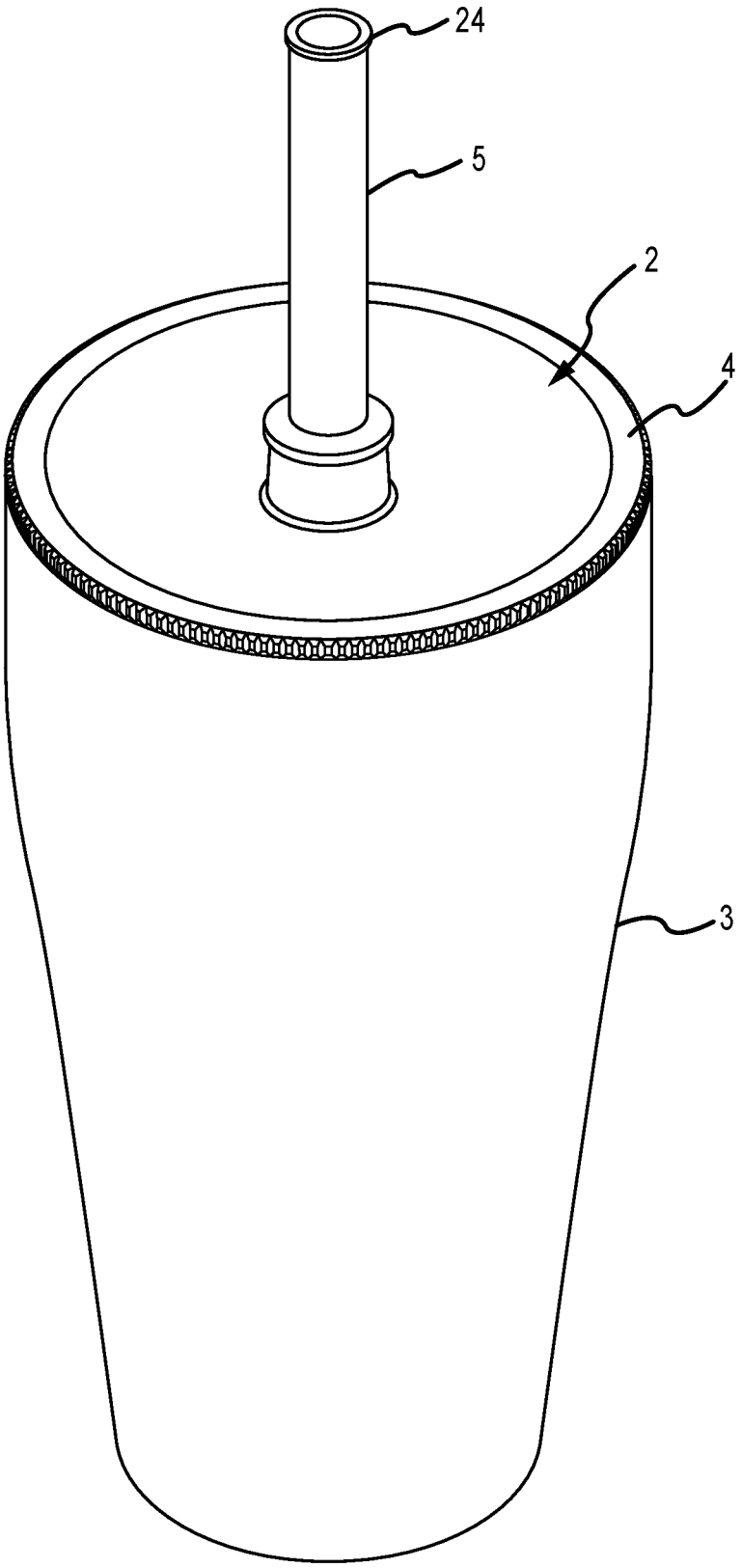
FIG. 1 is a perspective view of a beverage container having a cap that has an upper straw valve that can be positioned in an open or closed mode.

FIG. 1 discloses one embodiment of a cap structure 2 that is intended to be used on a rigid beverage container 3. The container 3 may comprise a variety of shapes. According to aspects of the present disclosure, the container is generally cylindrical in shape having a longitudinal axis that extends coaxially with the axis of the straw. The container may comprise other shapes and configurations, e.g., shorter, larger diameter, with a handle, sculpted side walls, etc., all of which are within the scope of the present disclosure.

Figure 2:
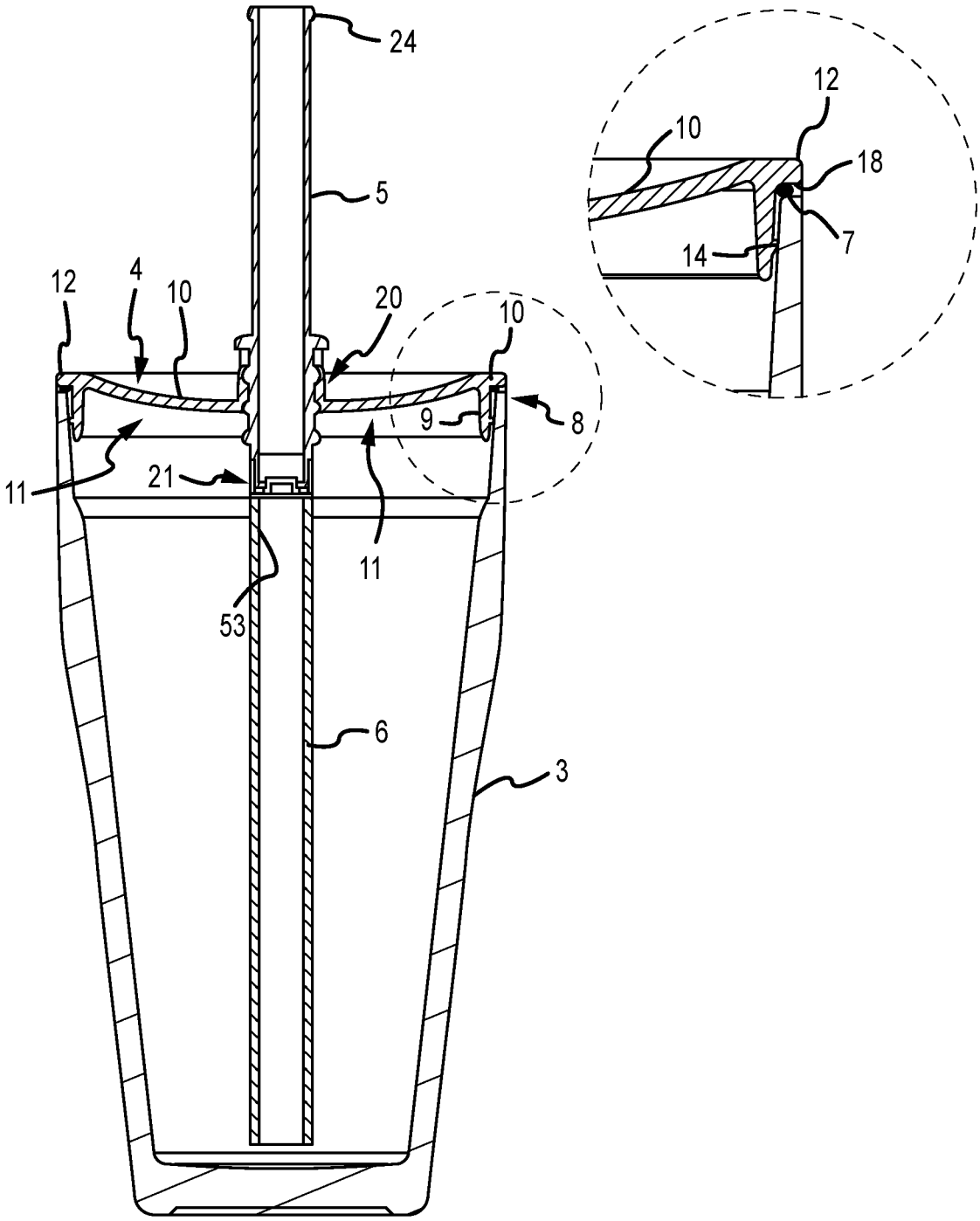
FIG. 2 is a cross section of a beverage container having a cap that has a straw that can be opened and closed with the upper straw valve positioned in the open mode.
Figure 10:
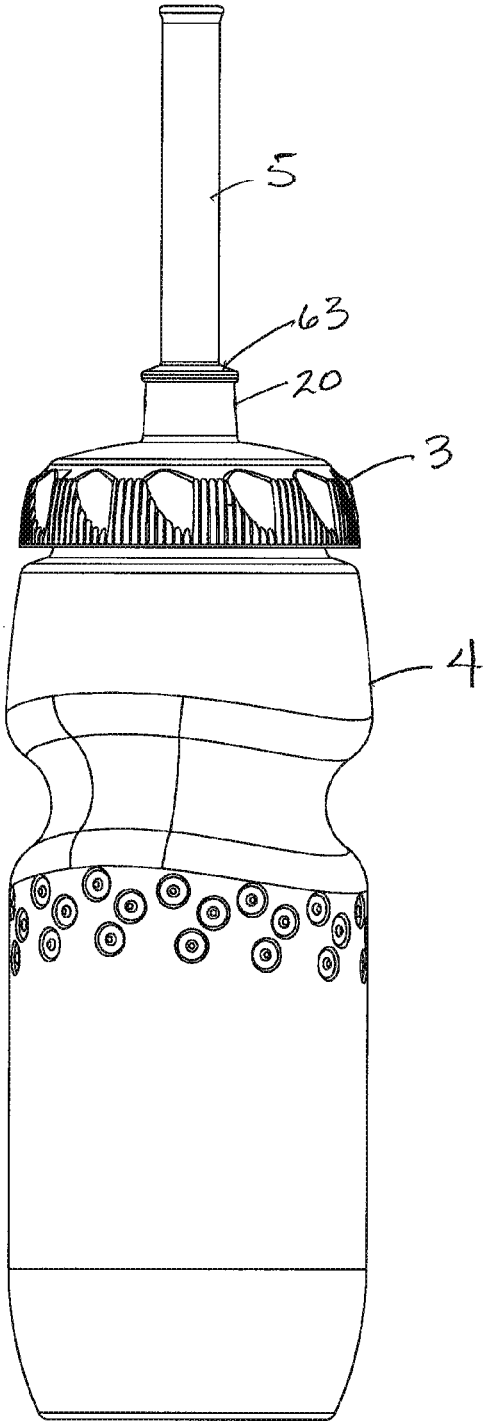
FIG. 10 is an orthogonal view of a bottle and cap that has an upper straw valve that can be positioned in an open and closed mode.
Figure 11:
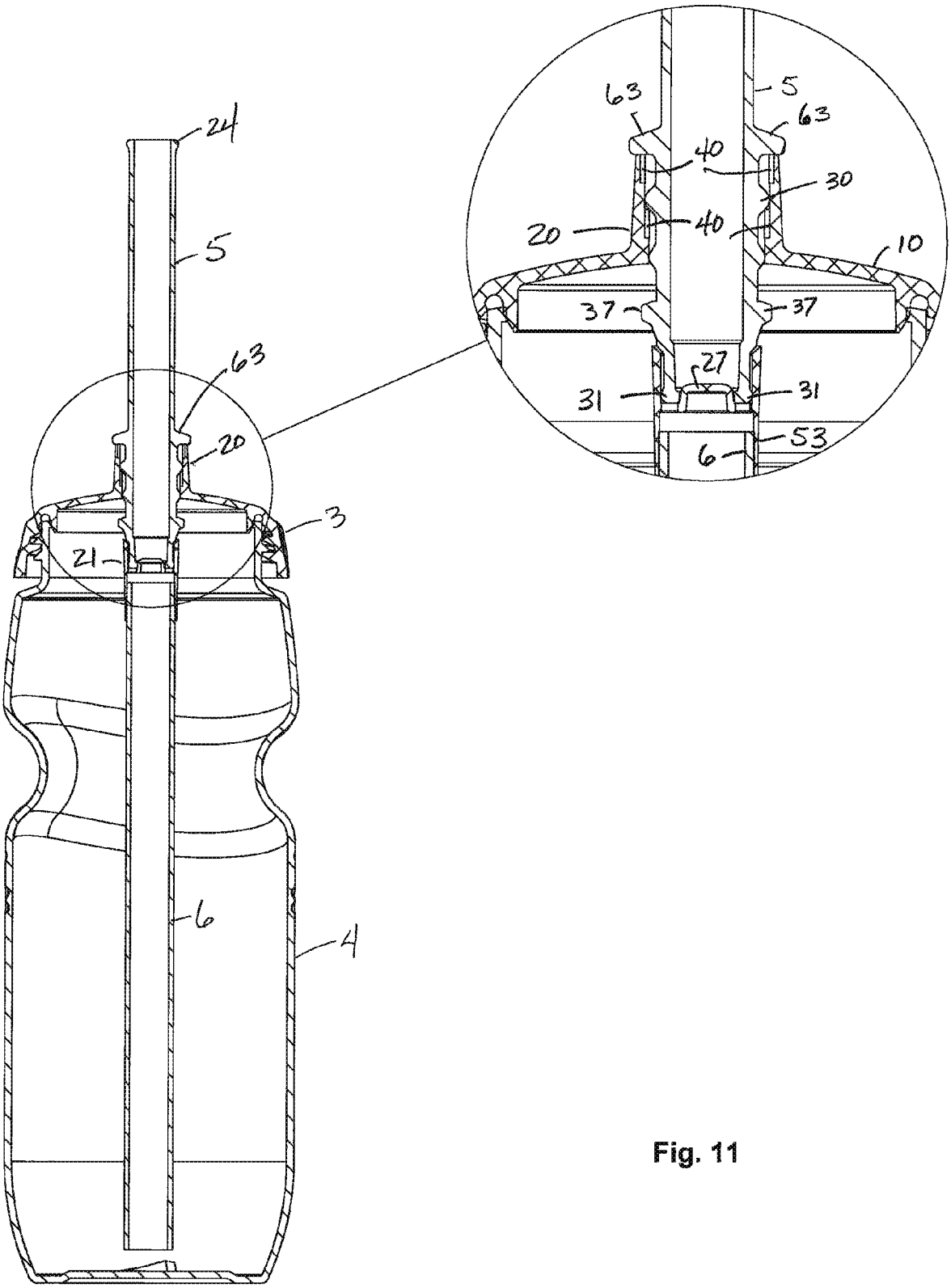
FIG. 11 is a section view of a bottle and cap that has an upper straw valve that can be positioned in an open and closed mode.

With reference to FIGS. 1 and 2, the cap structure 2 minimally comprises four parts: a cap body 4, upper straw valve 5, a lower straw 6 and an O-ring 7. The O-ring 7 is difficult to see in FIG. 2 due to the shading of the container 3 but is located at the recessed external shoulder 8 formed by the side wall 9 and upper wall 10 of the cap body 4. An alternative shape of container 3 and cap 2 is shown in FIGS. 10 and 11. In this embodiment, the cap body 4 is cylindrical and sized to form a hermetic seal across the open container neck 11 of container 3. The cap body 4 incorporates a sealing surface 12 that abuts the upper surface 13 of the container side wall. O-ring 7 also abuts the inside surface of the container, and the side wall 9 of the cap 4 incorporates screw threads 14 that engage mating features 15 of the container neck when the cap 2 is fully secured to the container. A lower straw 6 extends from the bottom of the cap body 4 into the container nearly reaching the container bottom. The lower straw may be formed integral with the cap or as a separate component as is discussed in greater detail herein.

Figure 3:
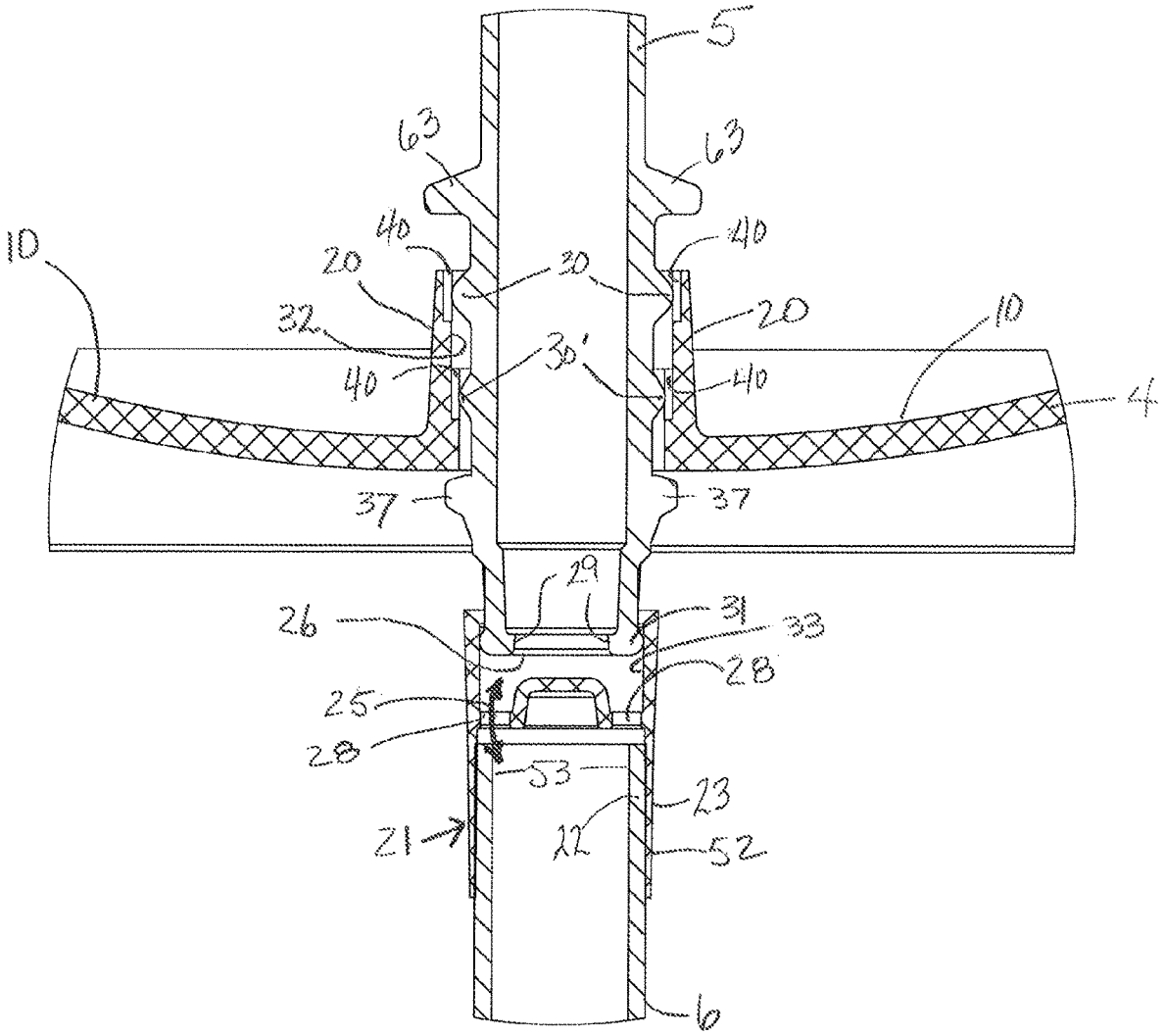
FIG. 3 is an enlarged partial cross section of a beverage container having a cap that has a straw that can be opened and closed with the upper straw valve positioned in the closed mode.

FIG. 3 provides a cross-section view of one embodiment of the cap body 4 and incorporated straw valve 5, with the straw valve 5 in an open position. The cap body 4 includes an upper collar 20 and a lower collar 21. In this embodiment, the lower straw 6 is held in place with conventional methods such as, with a press fit between mating surfaces 22 of the lower straw and the lower collar 21 of the cap body 4. The cap body 4 dispenses the fluid contents of the container upwardly and sequentially through the lower straw 6, cap body 4 and finally the proximal end 24 of a cylindrical upper straw valve 5. The upper straw valve 5 moves linearly within the upper collar 20 and lower collar 21. Movement of the straw valve 5 upwardly or outwardly relative to the cap 2 acts to open orifices 25 (seen in FIG. 3 and FIG. 4) within the lower collar 21 that form a flow path as fluid is dispensed from the container by the action of sipping on the straw. In contrast, FIG. 5 illustrates the straw valve 5 in a closed position. Here, the distal end 26 of the upper straw valve 5 is seated on plug 27 and blocks orifices 25. The cylindrical upper straw valve 5 is toggled from the open position illustrated in FIG. 3 and closed position in FIG. 5 by the operator. If the upper straw valve 5 is pushed downward or inward it closes or if it is pulled upward or outward it opens. In this configuration, the motion of the upper straw valve 5 is along the longitudinal axis of the container 3. In FIG. 3, one orifice 25 is identified by an arrow to show one beverage passageway. Other orifices are spaced around the plug 27 as seen in FIG. 4.

According to aspects of the present disclosure, the upper straw valve 5 may be configured with one or more upper and lower sealing members 30, 30' and 31 formed around the exterior surface, for example, in an O-ring geometry (FIGS. 3 and 5). When the upper straw valve 5 is in a closed position (FIG. 5), the upper sealing members 30 and 30' and lower sealing member 31 form a hermetic seal by pressing against the uninterrupted cylindrical inner surface 32 and 33 (FIG. 4) of the upper collar 20 and lower collar 21, respectively. When the straw valve 5 is in an open position, and a beverage is removed from the container via the upper straw valve 5, a negative pressure may be created within the container that could inhibit removal of the beverage. To maintain equalization of pressure between the inside and outside of the container while beverage is being removed through the straw, an air flow pathway is created between the sealing members 30 and 30' and the inner surface 32 of the upper collar 20 to permit ambient air external to the container to enter the container as the beverage is removed from the container via the upper straw valve 5. According to embodiments of the present disclosure, the sealing members 30, 30' and 31 move axially up or out relative to the cap 2 with the outward motion of the upper straw valve 5 to a position where sealing members 30 and 30' (not sealing member 31) are adjacent channels 40. In this position, the open position, the channels 40 remove contact between the sealing members 30 and 30' and the inner surface 32 of the upper collar 20 at the discrete locations where the channels 40 are formed. The gap formed between the sealing members 30 and 30' and the channels 40 allow ambient air to flow around the sealing members 30 and 30' and thereby allow the pressure within the container to equalize with ambient air pressures outside the container.

Figure 4:
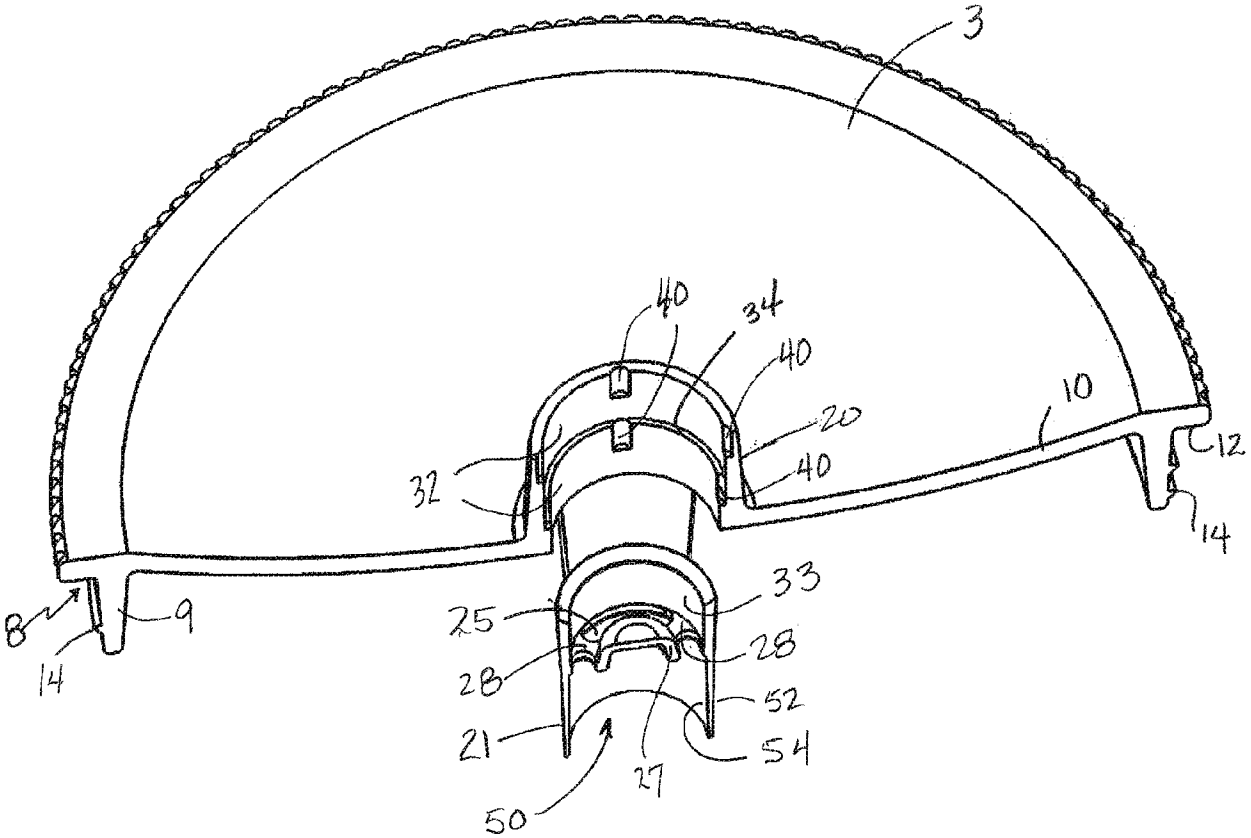
FIG. 4 is a perspective centerline section view of the top of the cap body.
Figure 5:
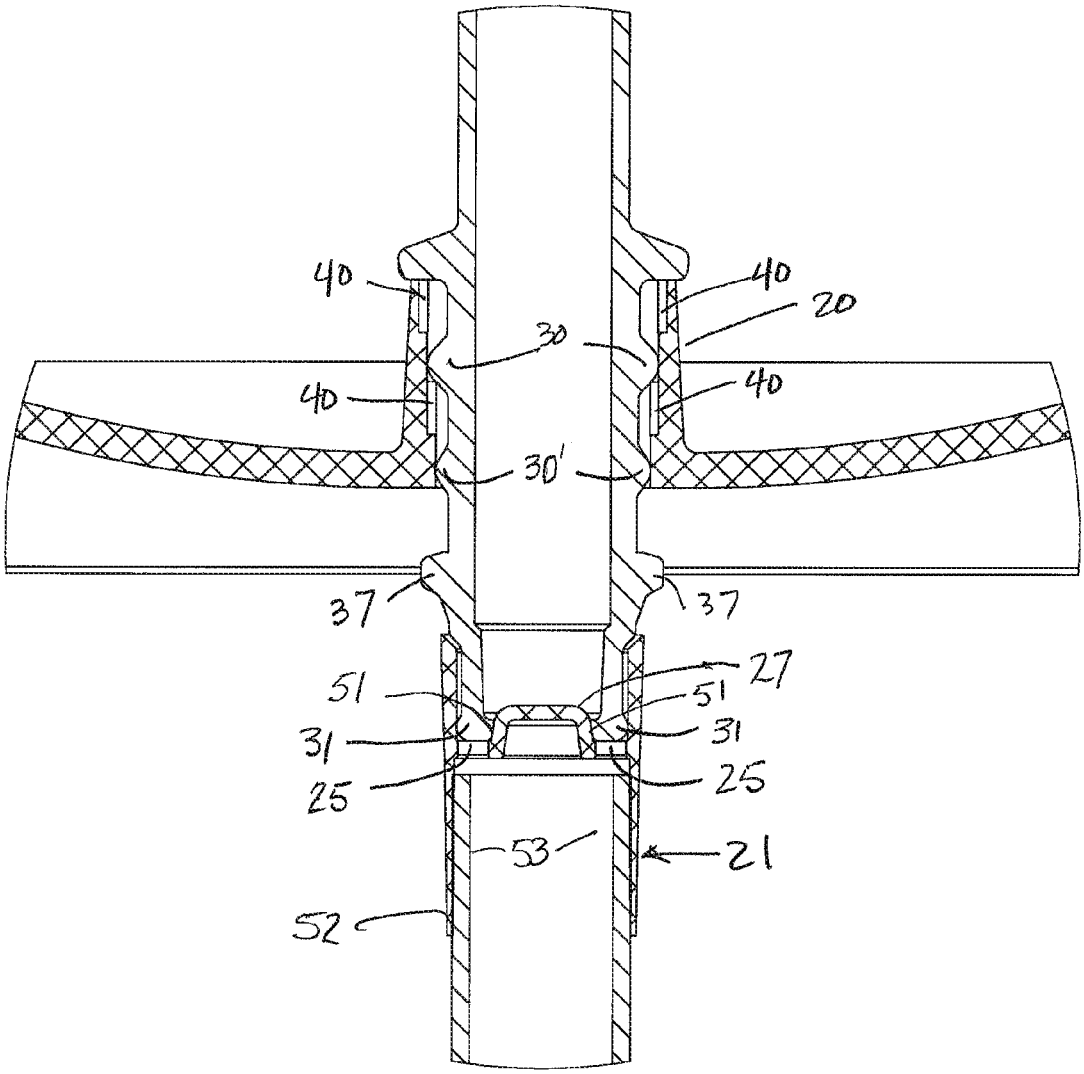
FIG. 5 is an enlarged partial cross section of a beverage container having a cap that has a straw that can be opened and closed with the upper straw valve positioned in the closed mode.
Figure 6:
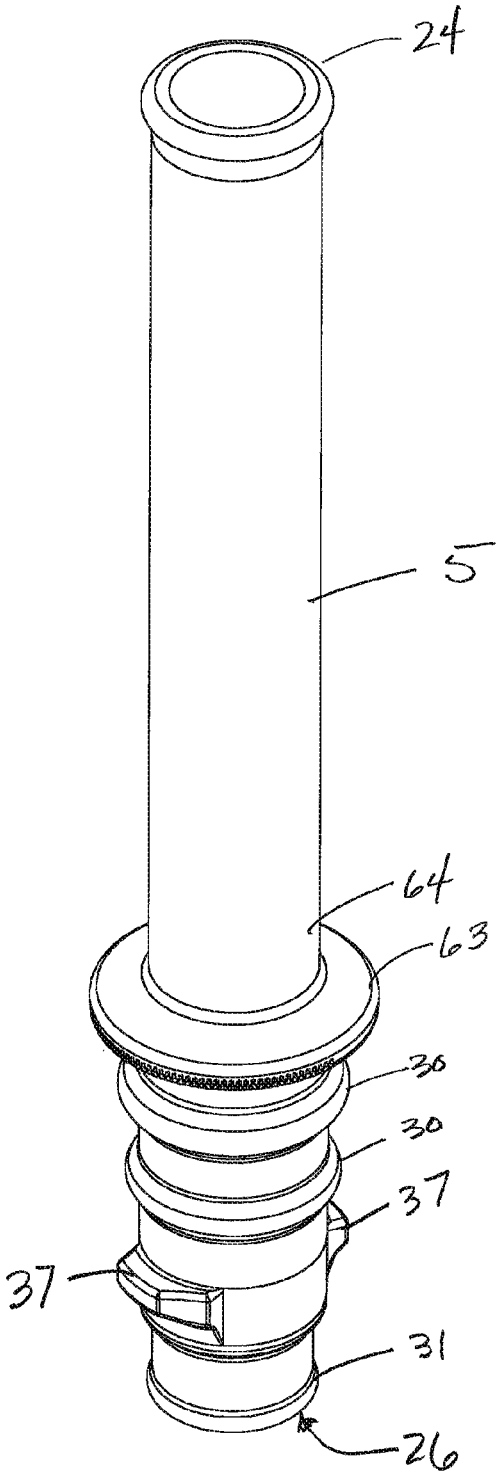
FIG. 6 is a perspective view of the upper straw valve.

As seen in FIG. 4, for manufacturing reasons, the inner surface 32 of the collar 20 is stepped inwardly at 34. It is difficult to form two sets of axially separated channels 40 without the inner surface 32 of collar 20 having a different diameter for each circumferential set of channels. Accordingly, the sealing member 30' has a smaller diameter compared to the sealing member 30. Utilizing a single sealing member 30, rather than two sealing members 30 and 30', would eliminate the need to have a stepped inner surface 32. In the preferred embodiment, the inner sealing surface 32 is undrafted to provide uniform compression forces on the sealing members 30 and 30' such that the upper straw valve does not rotate orthogonally to the longitudinal axis of the straw and compromise the bottom sealing member 31 as the semi rigid semi flexible straw is bent for the convenience the operator.

According to aspects of the present disclosure, the cap body 4 is rigid or semi rigid in nature and can be made from any number of rigid or semi rigid materials, for example, impact resistant thermoplastic or impact resistant polyethylene such as high-density polyethylene ("HDPE") and low-density polyethylene ("LDPE"). In contrast, the cylindrical upper straw valve 5 is made from a semi flexible semi rigid material, for example, thermoplastic (TPE) such as urethane, silicone, natural rubber, synthetic rubber or polyimide, because soft properties of these materials are good for accommodating surface imperfections and a press fit required in forming effective or hydraulic seals. In addition, the semi flexible semi rigid materials of the straw valve body 5 accommodate a user that might tug on the straw valve 5 with his teeth to pull it upward into the open position or bend the straw for convenience while taking a sip. The lower straw 6 can be made from a rigid material such as stainless steel or a rigid semi rigid material such as resistant thermoplastic or impact resistant polyethylene such as high-density polyethylene ("HDPE") and low-density polyethylene ("LDPE").

As previously noted, a plug 27 is positioned at the center of the opening 50 formed by the lower collar 21. Radially outwardly projecting spokes or lips 28 extend from the plug 27 to the inner surface 33 of the lower collar 21 to define orifices 25. In the closed position illustrated in FIG. 5, the distal end 26 of the upper straw valve 5 forms a hermetic seal with the inner surface 33 of the lower collar 21. More particularly, the sealing member 31 abuts the inner surface 33, the distal end 26 abuts the lips 28, and the inner surface 29 formed at the distal end of the upper straw valve 5 abuts the surface of plug 27. In preferred embodiments, surface 33 is cylindrical, polished and molded without draft to insure contact between surfaces 31 and 33 while the upper straw valve 5 is sliding from the open position to the closed position. In the open position, a hermetic seal is formed when surface 31 presses against surface 33. It is preferred that the plug 27 is cylindrical or frusto-conical in shape, polished and tapered to compress the material comprising the distal end 26 of the upper straw 5 between inner surface 33 of the lower collar 21 and outer surface 51 of the plug 27.

Figure 7:
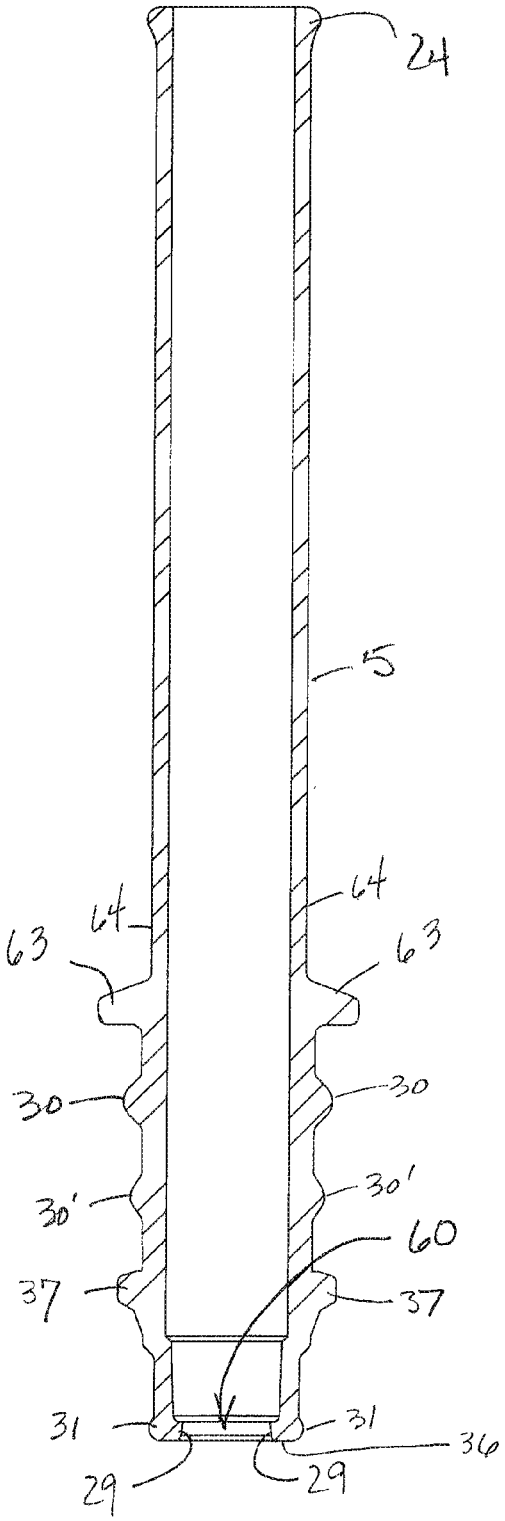
FIG. 7 is a section view of the upper straw valve.
Figure 8:
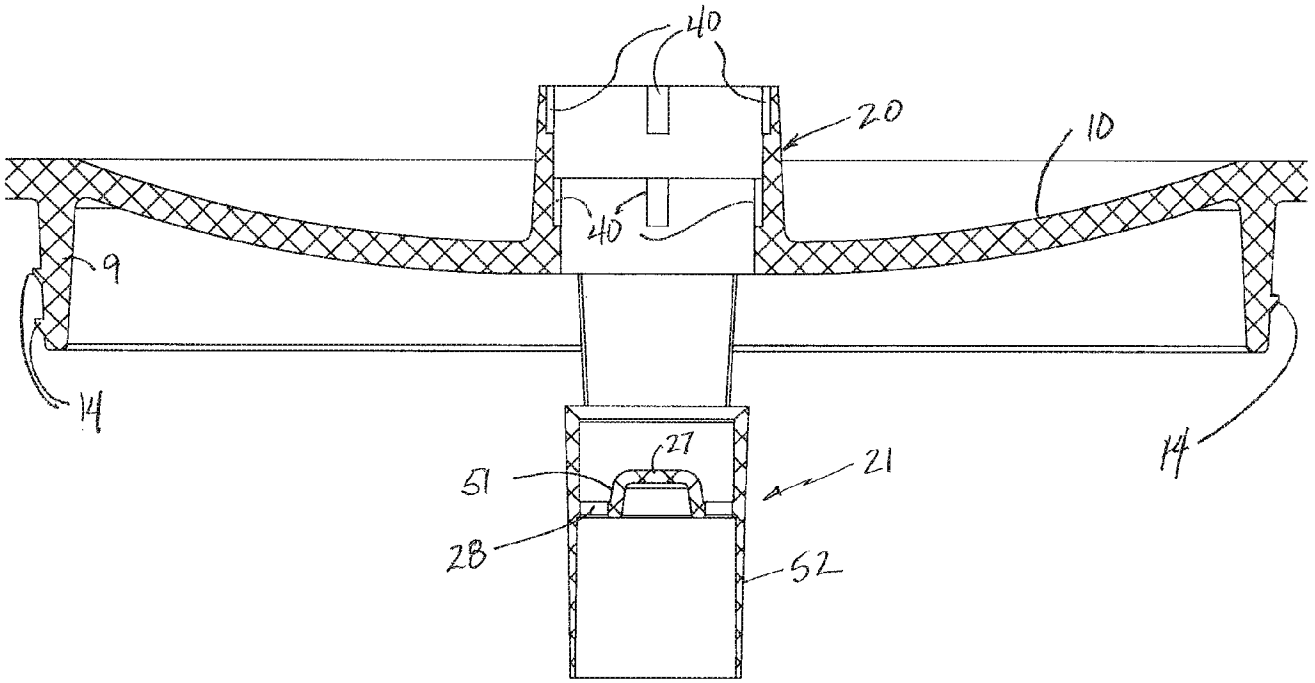
FIG. 8 is a section view of the cap body.

The lower collar 21 extends downwardly from lips 28 of the cap body 4 to form a sleeve 52 to receive the upper end 53 of the lower straw 6. The sleeve 52 has a tapered inner surface 54 that compresses the mating portion (the upper end 53) of the lower straw 6 (FIGS. 4 and 5) to form a hermetic seal and a mechanical bind or friction fit in a conventionally understood method. The orifices 25 in lip 28 allow fluid to flow from the lower straw 6 through lower collar and into the distal end 26 of the upper straw valve 5 when the straw valve 5 is not closed. In a preferred embodiment, the area defined by the orifices 25 matches the area of the opening 60 (FIG. 7) of the distal end 26 of the upper straw valve 5 to optimize the flow of liquids through the upper straw valve 5.

When in a closed position, the bottom surface 36 of the straw valve 5 (FIG. 7) may engage lips 28 as shown in FIG. 5. Alternatively, the bottom surface 36 of the upper straw valve 5 may be spaced from the lips 28 provided the axially height of the plug 27 has a sufficiently long (axial) dimension such that surface 51 contacts inner surface 29 of the straw valve 5 to maintain a hermetic seal.

Figure 9:
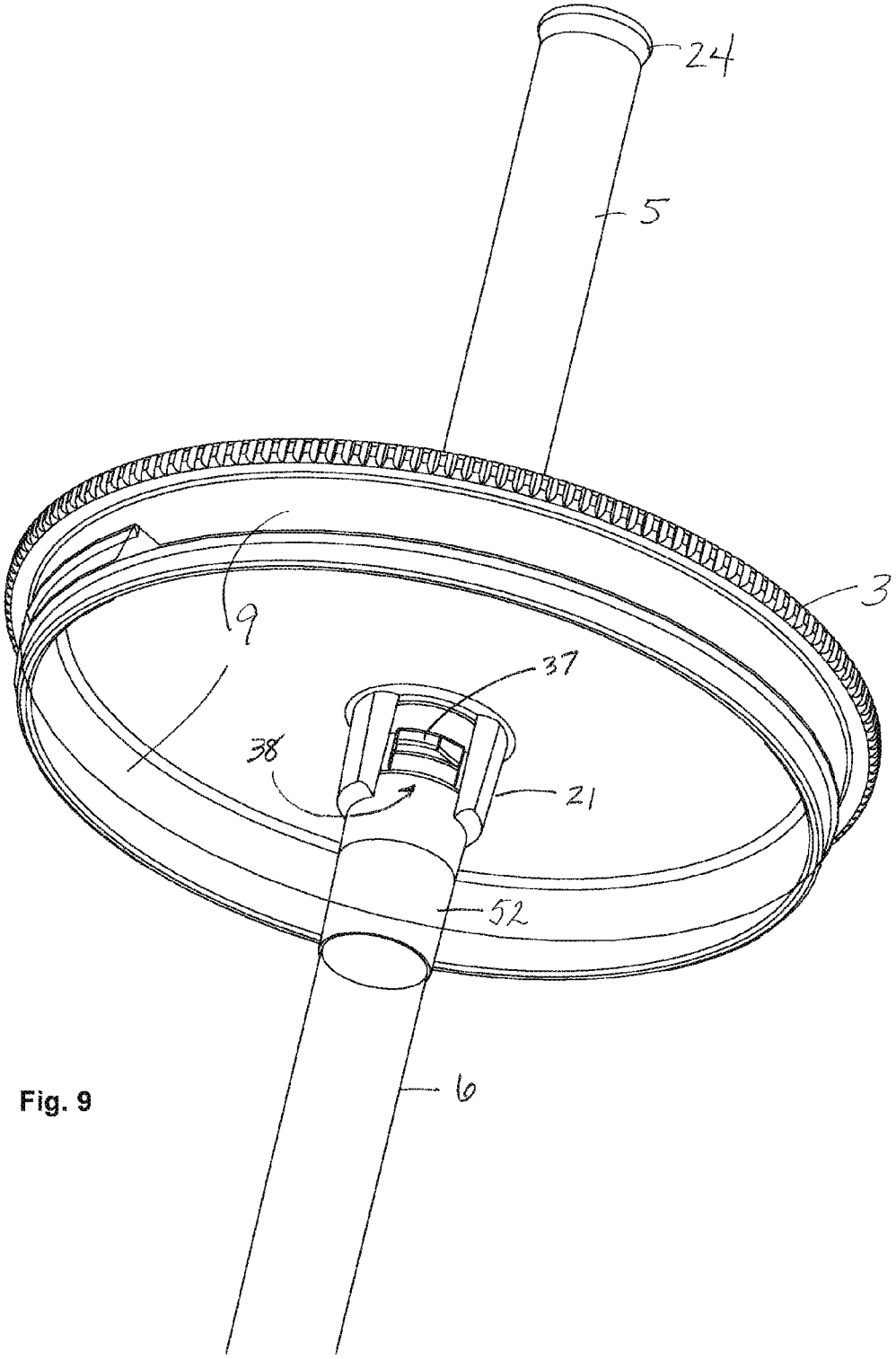
FIG. 9 is a perspective view of the cap looking upward from below the cap.

Preferably, the upper straw valve 5 comprises at least one ear 37 positioned in two different orifices 38 (FIG. 9). At least one ear 37 projects radially outward from the straw valve and is disposed within at least one orifice 38 (FIG. 9). Preferably, the upper straw valve 5 comprises at least two ears 37 and two orifices 38, with one ear positioned in one orifice. More preferably, the orifices would be symmetrically positioned about the circumference of the lower collar 21 at a position between the plug 27 and the upper wall 10 of the cap body 4.

Preferably, the upper straw valve 5 comprises a radially outwardly extending lip 63 that extends radially outwardly from the cylindrical surface 64 (FIG. 7) of the upper straw body 5. The lip 63 is preferably positioned above upper collar 20 when the upper straw valve 5 is in the closed position and has an outer diameter sized slightly larger than the outer diameter of upper collar 20 (FIG. 5). Lip 63 provides a surface for the operator to pull the upper straw valve 5 upward to the open position and push it downward to the closed position. The position of lip 63 relative to the top of collar 20 also provides visual cue that the upper straw valve 5 is either opened or closed based on its proximity to the lip 63 relative to the collar 20 (compare FIGS. 3 and 5).

Although the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter. It is noted that the examples shown and described are provided for purposes of illustration and are not intended to be limiting.

While various embodiments of the present invention have been described in detail, it is apparent that modifications and alterations of those embodiments will occur to those skilled in the art. For example, embodiments may incorporate some or all of the features of the US Patents and published application incorporated herein by reference. However, it is to be expressly understood that such modifications and alterations are within the scope and spirit of the present invention, as set forth in the following claims. Other modifications or uses for the present invention will also occur to those of skill in the art after reading the present disclosure. Such modifications or uses are deemed to be within the scope of the present invention.

What is claimed is:

1. A container that is adapted to hold a fluid for dispensing, comprising:

a container having an opening;

a cap structure mountable to the container and enclosing the opening, the cap structure having a cap body, a first collar extending outwardly from an exterior surface of the cap body and forming an outer opening in the cap structure at a proximal end of the first collar, a second collar extending inwardly from an interior surface of the cap body and forming an inner opening at a distal end of the second collar and a first fluid passage between the inner opening and the first collar, the second collar having an inner surface and a plug spaced from the inner surface, the plug partially blocking the fluid passage, and a plurality of first lips extending from the plug to the inner surface of the second collar to define at least one orifice;

a valve disposed within both the first collar and a proximal end of the second collar and extending outwardly from the first collar, the valve comprises a cylindrical surface forming a second fluid passage extending from a distal end to a proximal end, a valve opening disposed at the distal end, and at least one first sealing member disposed at the distal end, the at least one first sealing member is operable to be seated on the plug and form a seal between a surface of the at least one first sealing member and the inner surface of the second collar and between an inner surface of the at least one first sealing member and an outer surface of the plug when the valve is in a closed position, wherein the closed position prevents flow of a fluid through the valve opening, the valve is operable to move between the closed position and an open position, wherein the open position permits flow of the fluid through the at least one orifice; and a hollow tubular member connected to the distal end of the second collar and extending away from the distal end of the second collar, the hollow tubular member in fluid communication with the valve when the valve is in the open position and the hollow tubular member is not in fluid communication with the valve when the valve is in the closed position.

2. The container of claim 1, wherein the outer surface of the plug is tapered and is operable to compress the at least one first sealing member between the inner surface of the second collar and the outer surface of the plug when the valve is in the closed position.

3. The container of claim 1, wherein the valve includes at least one second sealing member, wherein the at least one second sealing member forms a hermetic seal by pressing against an inner surface of the first collar, and the at least one first sealing member forms a hermetic seal by pressing against the inner surface of the second collar when the valve is in the closed position.

4. The container of claim 3, wherein the first collar comprises at least one channel disposed on the inner surface, wherein a gap is formed between the at least one second sealing member and the at least one channel, thereby allowing a pressure within the container to equalize with ambient air pressure outside of the container when the valve is in the open position.

5. The container of claim 1, wherein the second collar includes at least one opening and the valve includes at least one ear projecting from the valve and positioned in the at least one opening, wherein the at least one ear is operable to constrain movement of the valve between the open position and the closed position.

6. The container of claim 1, wherein the inner surface of the second collar is tapered at the distal end and compresses an upper end of the hollow tubular member to form a hermetic seal between the inner surface and the upper end.

7. The container of claim 1, wherein the hollow tubular member is connected to the distal end of the second collar via a friction fit.

8. The container of claim 1, wherein the valve comprises a second lip that extends radially outwardly from the cylindrical surface and is positioned outwardly of the proximal end of the first collar.

9. The container of claim 8, wherein the second lip has an outer diameter larger than an outer diameter of the first collar.

10. A cap for closing a fluid container, comprising:

a cap body;

a first collar extending outwardly from an exterior surface of the cap body and forming an outer opening in the cap structure at a proximal end of the first collar;

a second collar extending inwardly from an interior surface of the cap body and forming an inner opening at a distal end of the second collar wherein a passage extends between the inner opening of the second collar and the outer opening of the first collar, the second collar having an inner surface, a plurality of lips extending inwardly from the inner surface of the second collar and supporting a plug within the passage and partially blocking the passage, the plurality of lips defining at least one orifice;

a valve disposed within both the first collar and a proximal end of the second collar, the valve comprises a cylindrical surface having a hollow interior extending from a distal end to a proximal end and at least one lower sealing member disposed at the distal end, the proximal end of the valve extending outwardly from the outer opening of the first collar, the at least one lower sealing member operable to be seated on the plug and form a seal between a surface of the at least one lower sealing member and the inner surface of the second collar and between an inner surface of the at least one lower sealing member and an outer surface of the plug when the valve is in a closed position to prevent flow of a fluid through the at least one orifice, the valve is operable to move between the closed position and an open position, wherein the open position permits flow of the fluid through the at least one orifice and exit the container through the outer opening of the first collar; and an elongate hollow member in fluid communication with the distal end of the second collar and extending away from the distal end of the second collar, the hollow member in fluid communication with the hollow interior of the valve when the valve is in the open position and the hollow member not in fluid communication with the hollow interior of the valve when the valve is in the closed position.

11. The cap of claim 10, wherein the outer surface of the plug is tapered and is operable to compress the distal end of the valve between the inner surface of the second collar and the outer surface of the plug when the valve is in the closed position.

12. The cap of claim 10, wherein the valve includes at least one upper sealing member, wherein the at least one upper sealing member and the at least one lower sealing member are operable to form a hermetic seal by pressing against an inner surface of the upper collar and the inner surface of the lower collar, respectively, when the valve is in the closed position.

13. The cap of claim 12, wherein the upper collar comprises at least one channel disposed on the inner surface, wherein a gap is formed between the upper sealing members and the at least one channel, thereby allowing a pressure within the container to equalize with ambient air pressure outside of the container when the valve is in the open position.

14. The cap of claim 10, wherein the second collar includes at least one opening and the valve includes at least one ear projecting from the valve and positioned in the at least one opening, wherein the at least one ear is operable to constrain movement of the valve between the open and closed position.

15. The cap of claim 10, wherein the inner surface of the second collar is tapered at the distal end and compresses an upper end of the hollow tubular member to form a hermetic seal between the inner surface and the upper end.

16. The cap of claim 10, wherein the elongate hollow member is disposed within the distal end of the second collar via a friction fit.

17. The cap of claim 10, wherein the valve comprises an annular lip that extends radially outwardly from the cylindrical surface and is positioned outwardly from the outer opening of the first collar.

18. The cap of claim 17, wherein the lip has an outer diameter larger than an outer diameter of the first collar.

19. A container that is adapted to hold a fluid for dispensing:

a container having an opening;

a cap structure mountable to the container and enclosing the opening, the cap structure having a cap body, a first collar extending outwardly from an exterior surface of the cap body and forming an outer opening in the cap structure at a proximal end of the first collar, a second collar extending inwardly from an interior surface of the cap body and forming an inner opening at a distal end of the second collar and a first fluid passage between the inner opening and the first collar, the second collar having an inner surface and a plug spaced from the inner surface, the plug partially blocking the fluid passage, and a plurality of first lips extending from the plug to the inner surface of the second collar to define at least one orifice;

a valve disposed within both the first collar and a proximal end of the second collar and extending outwardly from the first collar, the valve comprises a cylindrical surface forming a second fluid passage extending from a distal end to a proximal end, a valve opening disposed at the distal end, and at least one first sealing member disposed at the distal end, the at least one first sealing member is operable to be seated on the plug and form a seal between a surface of the at least one first sealing member and the inner surface of the second collar and between an inner surface of the at least one first sealing member and an outer surface of the plug when the valve is in a closed position, wherein the closed position prevents flow of a fluid through the valve opening, the valve is operable to move between the closed position and an open position, wherein the open position permits flow of the fluid through the at least one orifice.

20. The container of claim 19, further comprising a tubular member connected to the distal end of the second collar and extending away from the distal end of the second collar, the tubular member in fluid communication with the hollow interior of the valve when the valve is in the open position and the tubular member not in fluid communication with the hollow interior of the valve when the valve is in the closed position.

* * * * *